US008645142B2

(12) United States Patent
Teutsch et al.

(10) Patent No.: US 8,645,142 B2
(45) Date of Patent: Feb. 4, 2014

(54) SYSTEM AND METHOD FOR METHOD FOR IMPROVING SPEECH INTELLIGIBILITY OF VOICE CALLS USING COMMON SPEECH CODECS

(75) Inventors: Heinz Teutsch, Greenbrook, NJ (US); John Cornelius Lynch, Ontario (CA)

(73) Assignee: Avaya Inc., Basking Ridge, NJ (US)

( * ) Notice: Subject to any disclaimer, the term of this patent is extended or adjusted under 35 U.S.C. 154(b) by 30 days.

(21) Appl. No.: 13/430,936

(22) Filed: Mar. 27, 2012

(65) Prior Publication Data

US 2013/0262128 A1 Oct. 3, 2013

(51) Int. Cl.
*G10L 13/02* (2013.01)

(52) U.S. Cl.
USPC ..... 704/262; 704/220; 704/225; 704/222; 704/209; 381/94.3; 381/94.1; 379/269

(58) Field of Classification Search
USPC ..... 704/226, 223, 219, 205, 208, 233, 203, 704/222, 225, 206, 220, 209, 230, 262, 704/207; 381/94.3, 320, 317, 94.2, 92, 381/94.1, 106; 375/243; 370/269
See application file for complete search history.

(56) References Cited

U.S. PATENT DOCUMENTS 5,251,263 A * 10/1993 Andrea et al. ..... 381/71.6
5,388,185 A * 2/1995 Terry et al. ..... 704/205
5,455,888 A * 10/1995 Iyengar et al. ..... 704/203
5,550,924 A * 8/1996 Helf et al. ..... 381/94.3
5,754,974 A * 5/1998 Griffin et al. ..... 704/206
5,878,389 A * 3/1999 Hermansky et al. ..... 704/226
5,905,969 A * 5/1999 Mokbel et al. ..... 704/203
6,035,048 A * 3/2000 Diethorn ..... 381/94.3
6,765,931 B1 * 7/2004 Rabenko et al. ..... 370/493
2009/0281800 A1 * 11/2009 LeBlanc et al. ..... 704/224
2009/0281801 A1 * 11/2009 Thyssen et al. ..... 704/225
2009/0281803 A1 * 11/2009 Chen et al. ..... 704/226
2009/0287496 A1 * 11/2009 Thyssen et al. ..... 704/500

* cited by examiner

*Primary Examiner* — Vijay B Chawan
(74) *Attorney, Agent, or Firm* — Kacvinsky Daisak PLLC; John Maldjian, Esq.; Alexander D. Walter, Esq.

(57) ABSTRACT

System and method to improve intelligibility of coded speech, the method including: receiving an encoded speech signal from a network; extracting an encoded media data stream and one or more control data packets from the encoded speech signal; decoding the encoded media data stream to produce a decoded speech signal; boosting an upper spectral portion of the decoded speech signal to produce a boosted speech signal; and outputting the boosted speech signal. In another embodiment, the method may include: receiving an uncoded speech signal; processing the uncoded speech signal, wherein the processing comprises generating an unencoded data stream from the uncoded speech signal; boosting an upper spectral portion of the unencoded data stream to produce a boosted speech signal; encoding the boosted speech signal to produce an encoded speech signal; and outputting the boosted speech signal.

17 Claims, 9 Drawing Sheets

400

450

SYSTEM AND METHOD FOR METHOD FOR IMPROVING SPEECH INTELLIGIBILITY OF VOICE CALLS USING COMMON SPEECH CODECS

BACKGROUND

1. Field of the Invention

Embodiments of the present invention generally relate to improving the intelligibility of voice calls, in particular for voice calls that may be subjected to one or more transcodings.

2. Description of Related Art

ITU-T Recommendation G.711 at 64 kbps and G.729 at 8 kbps are two codecs widely used in packet-switched telephony applications. ITU-T G.711 wideband extension ("G.711 WBE") is an embedded wideband codec based on a narrowband core interoperable with ITU-T Recommendation G.711 (both .mu.-law and A-law) at 64 kbps.

ITU-T Recommendation G.711, also known as a companded pulse code modulation (PCM), quantizes each input sample using 8 bits. The amplitude of the input signal is first compressed using a logarithmic law, uniformly quantized with 7 bits (plus 1 bit for the sign), and then expanded to bring it back to the linear domain. The G.711 standard defines two compression laws, the .mu.-law and the A-law. ITU-T Recommendation G.711 was designed specifically for narrowband input signals in the telephony bandwidth, i.e. 200-3400 Hz.

The standard ITU-T G.729 (which follows conjugate structure algebraic CELP), is based on a human speech model where the throat and mouth have the function of a linear filter with an excitation vector. For each frame in G.729, an encoder analyses input data and extracts the parameters of the CELP model such as linear prediction filter coefficients and the excitation vectors. The encoder searches through its parameter space, carries out the decode operation in each loop of the search and compares the output signal of the decode operation (i.e., the synthesized signal) with the original speech signal.

G.722 is an ITU standard codec that provides 7 kHz wideband audio at data rates from 48, 56 and 64 kbps. This is useful for VoIP applications, such as on a local area network where network bandwidth is readily available, and offers a significant improvement in speech quality over older narrowband codecs such as G.711, without an excessive increase in implementation complexity.

G.723.1 is an ITU standard codec that provides compressed voice audio at 5.3 Kbps and 6.3 Kbps. G.723.1 is mostly used in Voice over IP ("VoIP") applications due to its low bandwidth requirement. G.723.1 is designed to represent speech with a high quality at the above rates using a limited amount of complexity. It encodes speech or other audio signals in frames using linear predictive analysis-by-synthesis coding. The excitation signal for the high rate coder is Multipulse Maximum Likelihood Quantization (MP-MLQ) and for the low rate coder is Algebraic-Code-Excited Linear Prediction (ACELP). The frame size is 30 ms and there is an additional look ahead of 7.5 ms, resulting in a total algorithmic delay of 37.5 ms. All additional delays in this coder are due to processing delays of the implementation, transmission delays in the communication link and buffering delays of the multiplexing protocol.

Internet Low Bitrate Codec ("iLBC") is an open source narrowband speech codec described by RFC 3951. iLBC, uses a block-independent linear-predictive coding (LPC) algorithm and supports frame lengths of 20 ms at 15.2 kbit/s and 30 ms at 13.33 kbit/s.

SILK™ is an audio compression format and audio codec used by Skype™. SILK is usable with a sampling frequency of 8, 12, 16 or 24 kHz and a bit rate from 6 to 40 Kbps. SILK is described in further detail in IETF document "draft-vos-silk-02."

Filtering of an audio signal is integral to common speech codec operation. By the Nyquist theorem, signals must be sampled at a rate at of least twice the highest frequency present in the source signal, in order to avoid aliasing artifacts in the decoded audio signal. The required sampling rate can be reduced by using a low-pass filter to filter out high-frequency components from the source signal, in order to substantially limit the spectral content to within a desired low-pass bandwidth. Roll-off characteristics of the low-pass filter result in some attenuation of higher-frequency spectral components that are still within the desired low-pass bandwidth.

Some speech encoders such as G.711 and G.722 at 64 Kbps use a relatively high bit rate in order to encode the raw audio waveform with relatively little encoding loss within the bandwidth of interest. Because such encoders encode the raw audio waveform more directly, no assumptions are made about the source of the raw audio waveform and the encoding is relatively high quality for non-speech sounds, within the available bandwidth and resolution limits.

In contrast, some lower bit rate speech encoders such as G.729 and G723.1 operate on the principle of linear predictive coding ("LPC"), such that a lower bit rate is achieved by fitting the raw audio waveform to a parametric model of the human voice tract, and then encoding the parameters of the model that upon decoding would produce a close approximation to the raw audio waveform. However, a drawback of such encoders is that if the raw audio waveform includes non-speech components (e.g., spectral levels or temporal dynamics not ordinarily found in human speech), the encoder produces a relatively lower quality encoding. That is, upon decoding, the decoded audio waveform would not be a good approximation to the raw audio waveform. Furthermore, in order to achieve a low bit rate encoding, high frequency components of the raw audio waveform may be more attenuated compared to lower-frequency components.

Calls subjected to multiple transcodings by lower bit rate encoders may suffer from excessive high-frequency attenuation and potentially intelligibility problems. Hands-free calls may especially experience a higher attenuation, depending on the acoustic environment the speakerphone is positioned in. A problem of the known art is that many speech codecs, such as narrowband voice codecs and in particular the G.729 codec, attenuate high-frequency speech components (i.e., greater than around 1500 Hz) with each encoding. As a rule of thumb, each G.729 encoding attenuates frequencies above 1500 Hz by around 3 dB for a clean input signal, such as a noise-free handset/headset recording.

A loss of high-frequency components is known to have a negative impact on speech intelligibility, in particular when dealing with fricative sounds such as the sound of the letter "f" versus the sound of the letter "s". For example, consider a conference call, with participants from different locations of a corporation. Participants call into a conferencing system using a single telephone number plus an ID code to identify the conference, and the conferencing system bridges the calls together. Voice signals to and from participants may be transmitted as a Voice over Internet Protocol ("VoIP") call over a wide area network ("WAN") linking the different corporate locations. Corporate policy may dictate that all calls crossing the WAN to be established using the G.729 codec to conserve bandwidth. However, the conference bridge may only accept data encoded using G.711. Hence, media gateways situated immediately in front of the bridge transcode the audio stream from G.729 to G.711 and back to G.729. As a result each call has to undergo two G.729 encoding steps (i.e., one in the endpoint and one in the gateway), resulting in an attenuation of the high frequencies in the audio stream of at least 6 dB.

Therefore, a need exists to compensate for multiple encoding conversions and/or filtering, in order to provide improved speech intelligibility.

SUMMARY

Embodiments of the present invention generally relate to increasing the intelligibility of voice signals encoded and decoded using narrowband voice encoders, and, in particular, to a system and method for boosting the high-frequency spectral content of voice signals in order to improve intelligibility. The proposed method improves speech intelligibility of voice calls that may be subjected to one or more transcodings.

In one embodiment, a method to improve intelligibility of coded speech may include: receiving an encoded speech signal from a network; extracting an encoded media data stream and one or more control data packets from the encoded speech signal; decoding the encoded media data stream to produce a decoded speech signal; boosting an upper spectral portion of the decoded speech signal to produce a boosted speech signal; and outputting the boosted speech signal.

In one embodiment, a method to improve intelligibility of coded speech may include: receiving an uncoded speech signal; processing the uncoded speech signal, wherein the processing comprises generating an unencoded data stream from the uncoded speech signal; boosting an upper spectral portion of the unencoded data stream to produce a boosted speech signal; encoding the boosted speech signal to produce an encoded speech signal; and outputting the boosted speech signal.

In one embodiment, a system to improve intelligibility of coded speech may include: a receiver configured to receive an encoded speech signal from a network; an extraction module configured to extract an encoded media data stream and one or more control data packets from the encoded speech signal; a decoder configured to decode the encoded media data stream to produce a decoded speech signal; a frequency-selective booster configured to boost an upper spectral portion of the decoded speech signal to produce a boosted speech signal; and a transmitter configured to transmit the boosted speech signal.

BRIEF DESCRIPTION OF THE DRAWINGS

The above and still further features and advantages of the present invention will become apparent upon consideration of the following detailed description of embodiments thereof, especially when taken in conjunction with the accompanying drawings wherein like reference numerals in the various figures are utilized to designate like components, and wherein.

Figure 1:
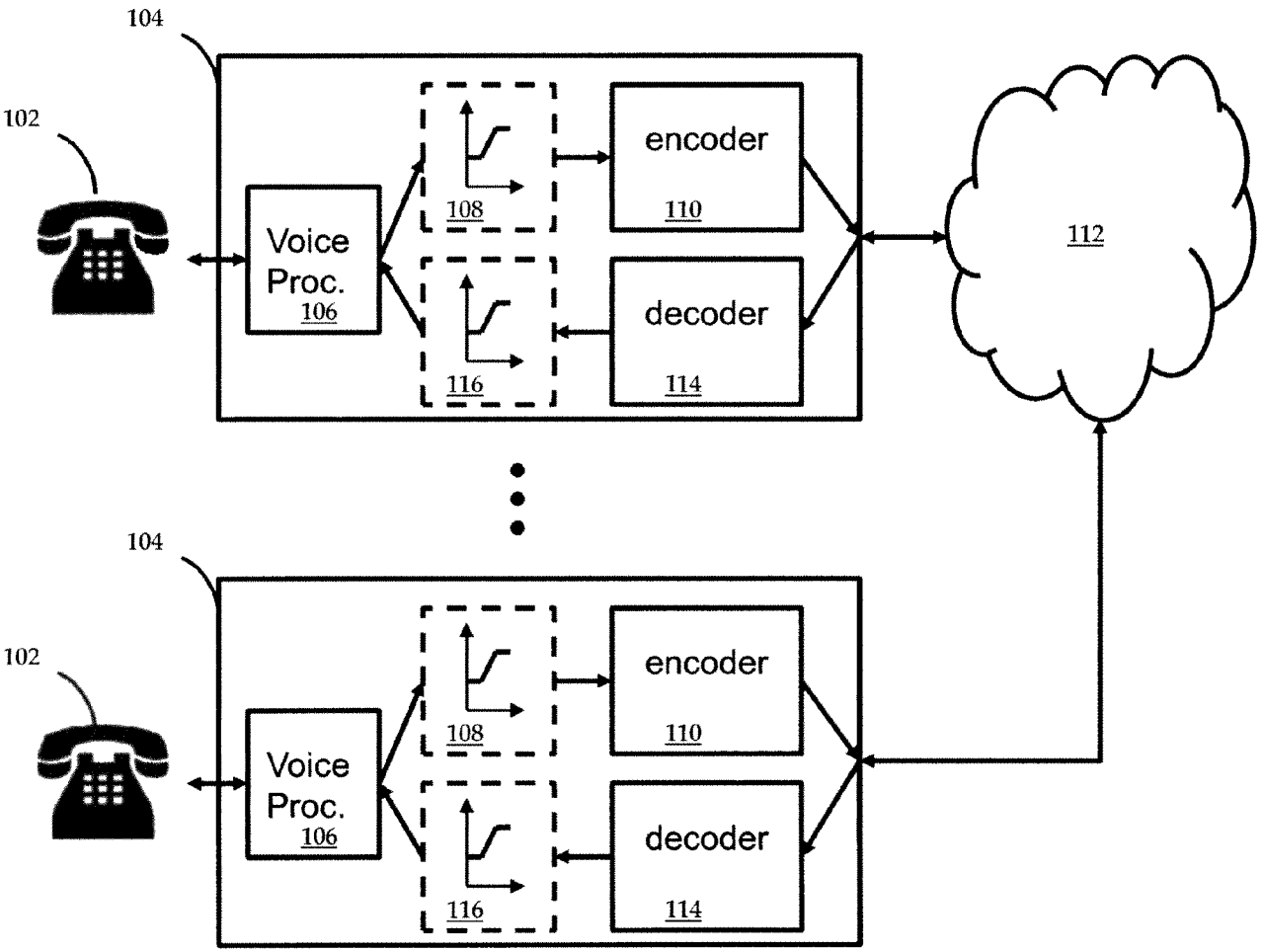
FIG. 1 illustrates at a high level of abstraction a block diagram of a network in accordance with an embodiment of the present invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures. Optional portions of the figures may be illustrated using dashed or dotted lines, unless the context of usage indicates otherwise.

DETAILED DESCRIPTION

Embodiments of the present invention generally relate to improved speech intelligibility in a telephone call, and, in particular, to a system and method for providing either pre- or post-emphasis to compensate for spectral artifacts caused by multiple encoding and decoding cycles through speech encoders, such as by boosting high frequency spectral content relative to lower frequency spectral content. Processing may take place as part of a module that implements a speech encoder and/or a speech decoder. The encoder/decoder may be located in a variety of places, such as a media gateway, in a conference mixer, in an endpoint, in a call center, in a Private Branch Exchange ("PBX"), etc.

As used throughout herein, higher-frequency spectral content or upper spectral portion refers to spectral content above approximately 1500 Hz, and lower-frequency spectral content or lower spectral portion refers to spectral content below approximately 1500 Hz, unless a different meaning is clearly indicated either explicitly or implicitly from the context.

In the following detailed description, numerous specific details are set forth in order to provide a thorough understanding of embodiments or other examples described herein. In some instances, well-known methods, procedures, components and circuits have not been described in detail, so as to not obscure the following description. Further, the examples disclosed are for exemplary purposes only and other examples may be employed in lieu of, or in combination with, the examples disclosed. It should also be noted the examples presented herein should not be construed as limiting of the scope of embodiments of the present invention, as other equally effective examples are possible and likely.

The terms "switch," "server," "contact center server," or "contact center computer server" as used herein should be understood to include a Private Branch Exchange ("PBX"), an ACD, an enterprise switch, or other type of telecommunications system switch or server, as well as other types of processor-based communication control devices such as, but not limited to, media servers, computers, adjuncts, and the like.

As used herein, the term "module" refers generally to a logical sequence or association of steps, processes or components. For example, a software module may comprise a set of associated routines or subroutines within a computer program. Alternatively, a module may comprise a substantially self-contained hardware device. A module may also comprise a logical set of processes irrespective of any software or hardware implementation.

As used herein, the term "gateway" may generally comprise any device that sends and receives data between devices. For example, a gateway may comprise routers, switches, bridges, firewalls, other network elements, and the like, any and combination thereof.

As used herein, the term "transmitter" may generally comprise any device, circuit, or apparatus capable of transmitting an electrical signal.

FIG. 1 illustrates at a high level of abstraction a network 100 in accordance with an embodiment of the present invention. Network 100 includes a plurality of telecommunication terminals 102 that are each connected to a packet-switched wide area network 112 (e.g., a packet switched network, Ethernet, PSTN, etc.) through a gateway device 104. Gateway device 104 may include a voice processing module 106, a pre-emphasis filter 108, an encoder 110, a decoder 114 and a post-emphasis filter 116, interconnected as shown. As will be appreciated, network 100 is not limited to the modules illustrated, and may contain additional types and/or quantities of modules.

The gateway 104 may comprise Avaya Inc.'s, G250™, G350™, G430™, G450™, G650™, G700™, and IG550™ Media Gateways and may be implemented as hardware such as, but not limited to, via an adjunct processor or as a chip in the server.

Telecommunication terminals 102 may be a packet-switched device, and may include, for example, IP hardphones, such as the Avaya Inc.'s, 1600™, 4600™, and 5600™ Series IP Phones™; IP softphones running on any hardware platform such as PCs, Macs, smartphones, or tablets, (such as Avaya Inc.'s, IP Softphone™); Personal Digital Assistants or PDAs; Personal Computers or PCs, laptops; packet-based H.320 video phones and/or conferencing units; packet-based voice messaging and response units; and packet-based traditional computer telephony adjuncts.

Telecommunication terminals 102 may also include, for example, wired and wireless telephones, PDAs, H.320 video phones and conferencing units, voice messaging and response units, and traditional computer telephony adjuncts. Exemplary digital telecommunication devices include Avaya Inc.'s 2400™, 5400™, and 9600™ Series phones.

The packet-switched wide area network 112 of FIG. 1 may comprise any data and/or distributed processing network such as, but not limited to, the Internet. Packet-switched wide area network 112 typically includes proxies (not shown), registrars (not shown), and routers (not shown) for managing packet flows. The packet-switched wide area network 112 is in (wireless or wired) communication with an external first telecommunication device 102 via a gateway 104.

In one configuration, telecommunication device 102, gateway 104 and packet-switched wide area network 112 are Session Initiation Protocol or SIP compatible and may include interfaces for various other protocols such as, but not limited to, the Lightweight Directory Access Protocol or LDAP, H.248, H.323, Simple Mail Transfer Protocol or SMTP, IMAP4, ISDN, E1/T1, and analog line or trunk.

It should be emphasized the configuration of the switch, server, user telecommunication devices, and other elements as shown in FIG. 1 is for purposes of illustration only and should not be construed as limiting embodiments of the present invention to any particular arrangement of elements.

Speech encoding is a lossy process which inherently results in a loss of quality and/or intelligibility. Real systems may include filtering and variable delay, as well as distortions due to channel errors and low bit-rate codecs. However, quality is often subjective and may be measured in different ways. One method to measure quality is by use of the Perceptual Evaluation of Speech Quality ("PESQ") index. PESQ is a family of standards that include a test methodology for automated assessment of the speech quality as experienced by a user of a telephony system, and is standardized as ITU-T recommendation P.862. PESQ compares an original signal X(t) with a degraded signal Y(t) that is the result of passing X(t) through a communications system. The output of PESQ is a prediction of the perceived quality that would be given to Y(t) by subjects in a subjective listening test.

Furthermore, quality is not necessarily equivalent to or highly correlated with intelligibility. Standards to measure intelligibility include ANSI standard S3.5-1997, "Methods for calculation of the speech intelligibility index" (1997).

Speech encoding often produces a loss in high frequency spectral components of the speech signal. This spectral loss may become more accentuated with each successive encoding cycle. The decoded speech may sound increasingly muddy, resulting in a less intelligible speech signal. A loss of high frequency spectral components of the speech signal may produce a loss of intelligibility between phonemes that differ in fricatives, alveolar stops, and/or alveolar fricatives. Examples include the difference between the vocalizations of "x" and "s".

Embodiments in accordance with the present invention may compensate for the loss in high frequency spectral components by using spectral shaping to improve intelligibility of a conversation that is subjected to multiple transcodings. A goal is that the spectral shape of the compensated voice signal after decoding should approximate the spectral shape of the voice signal without encoding. However, the spectral shaping may result in a lower perceived quality as measured by the PESQ index. Nevertheless, the improvement in intelligibility arising from the spectral shaping may be enough to improve an otherwise completely unusable call into an acceptable call.

Embodiments in accordance with the present invention may improve speech intelligibility by applying a high-frequency spectral boost. The spectral boost may be applied as a pre-emphasis before the speech encoder, or be applied as a post-emphasis after the speech decoder.

A high-frequency pre-emphasis spectral boost before the speech encoder, in accordance with an embodiment of the present invention, may be useful for improving speech intelligibility. Pre-emphasis may be useful, for example, when an originating telecommunication terminal or a terminating telecommunication terminal is on a speakerphone, such that more high-frequency boost may be necessary. The impairment is introduced primarily by the encoder, i.e. the sender. Pre-emphasis in this scenario may be useful if the terminal is on using a speakerphone in a reverberant acoustic environment, in which case more high-frequency compensation may be needed because reverberations tend to favor lower frequency components. When using a speakerphone, a greater free-space distance exists between either a speaker's mouth and a microphone, or between a listener's ear and the speakerphone speaker. Free-space sound transmission is frequency dependent, and higher-frequency audible signals are attenuated by a relatively greater amount than low-frequency audible signals. Also, high frequencies emitted by a human travel more directionally than low frequencies emitted by a human.

Hence, in most cases, there will be a drop in high-frequency energy at the microphone if the user does not talk directly at the microphone. Therefore, there is an apparent loss of high-frequency spectral components when using a speakerphone. Furthermore, conversations using a speakerphone are subject to the acoustic environment of the speaker and the listener, including: the direction at which the user is speaking; the spatial response pattern of the microphone and/or speakerphone speaker; reverberations (i.e., echoes); sound dampening effects of people, upholstery and drapery within the room; multipath interference; scattering; refraction; and so forth. Information about the transmitting acoustic environment may be estimated by the terminal by emitting audio signals having a known characteristic (spectral, etc.) and comparing to a resulting signal recorded from the transmitting location. For example, a terminal could estimate the level of reverberation in a room by playing a known signal though the terminal's speaker and record it with the terminal's microphone, followed by signal processing to estimate model parameters.

If available, information about the transmitting acoustic environment may also be used to design a more tailored correction filter on either the sender side or the receiver side. Information about the transmitting acoustic environment may be derived from an automated discovery and/or calibration procedure such as a procedure described above. The calibration procedure may involve, for example, transmitting a known signal (e.g., swept frequency tone, or white noise, etc.) by the originating telecommunications terminal, and measuring the resultant signal received by the originating telecommunications terminal. The information about the transmitting acoustic environment may be transmitted via an overhead channel, control packets, an RTCP extension, or the like to the receiver side for use in providing a more tailored correction filter on the receiver side. Similarly, information about the acoustic environment on the receiving side may be used to design a tailored post-emphasis correction filter. For example, if the receiving speakerphone is located in a space where certain frequencies are attenuated (e.g., anti-resonances), special filters could be designed to compensate for the attenuation. These filters would have to be designed very carefully, though, because Room resonances and/or anti-resonances are typically relatively localized, therefore such filters should be designed carefully in order to avoid excessive amplification of certain frequencies.

The high-frequency boost relative to lower frequencies may be achieved either by providing an amplification of higher frequencies relative to lower frequencies, or a filtering of lower frequencies relative to higher frequencies (i.e., a high-pass shelf filter), or a combination thereof. Filtering may be performed in a digital domain by use of a digital filter, e.g., a finite-impulse-response ("FIR") filter or an infinite-impulse-response filter ("IIR"). The high-frequency boost may be selected to be within a range of approximately 3 dB to approximately 20 dB.

The order in which the high-frequency boost is applied (i.e., whether as a pre- or post-emphasis) is important because a speech codec is a non-linear operation. A gain in the high frequencies also boosts the level of the recorded background noise within the boosted frequencies. There may also be reverberation effects (e.g., echo feedback), which in turn may lead to additional distortion of the encoded speech signal if pre-emphasis is applied. Informal listening tests and perceptual testing in accordance with ITU-T P.862 confirm these effects.

Some speech encoders such as G.729 operate by using a predictive model of the human vocal tract in order to represent a spectral envelope of a digital speech signal in compressed form. Such speech encoders are designed to work best when the speech signal to encode has a high signal-to-noise ratio ("SNR"). However, when a signal to be encoded is not a speech signal, or contains significant non-speech components, the digitized speech produced by encoders/decoders such as G.729 will degrade in quality and intelligibility relatively quickly as the input SNR degrades. This may be a consideration when designing embodiments in accordance with the present invention. For example, a pre-compensator situated before a G.729 encoder may produce a boosted signal that the G.729 encoder is not optimally designed for. For example, the boosted signal will include a spectral content that is relatively enhanced at high frequencies, such as a higher noise floor and/or boosted harmonics at high frequencies. The enhancement may cause distortion in the encoding process, distorting the encoded speech signal such that a decoded signal may include distortion such as a crackling, or additional noise, etc.

In contrast, situating a compensator after a G.729 decoder (i.e., a post-compensator) may produce a boosted signal while still presenting to an upstream G.729 encoder a voice signal that is closer to the voice signal that it has been designed for. Therefore, the encoding process is not affected by the boost, and the encoded signal produced by the G.729 encoder does not include unwanted distortion cause by the boost.

Figure 2:
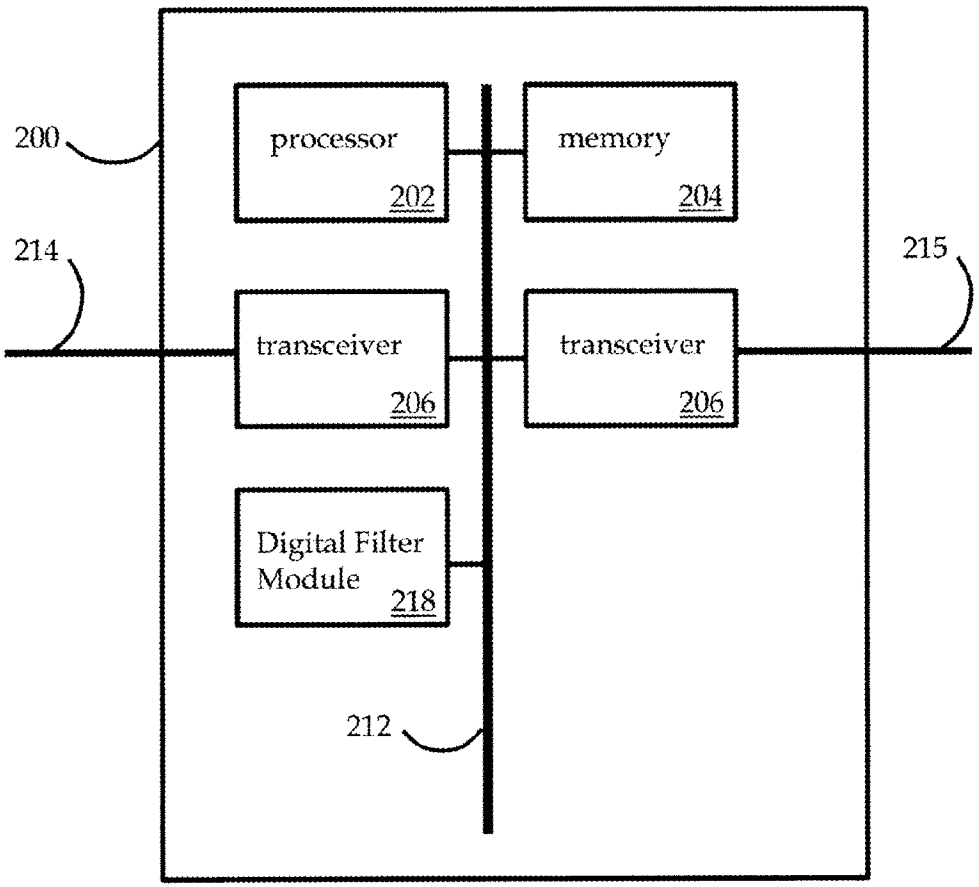
FIG. 2 illustrates at a high level of abstraction a processing apparatus to provide a spectral boost, in accordance with an embodiment of the present invention.

FIG. 2 illustrates at a high level of abstraction a processing apparatus 200 to provide a spectral boost. Processing apparatus 200 may be configured as either pre-emphasis filter 108 or post-emphasis filter 116. Processing apparatus 200 may be a stand-alone unit, or may be incorporated within a larger processing apparatus. Processing apparatus 200 may include a processor 202, a memory 204, one or more transceivers 206 and a digital filter module 218, interconnected via data bus 212. Transceivers 206 may be used to provide a communication interface 214 with voice processing module 106, and/or a communication interface 215 with encoder 110 or decoder 114. Memory 204 stores software processes and associated data that, when executed by processor 202 and/or digital filter module 218, carry out a digital filtering process.

Figure 3A:
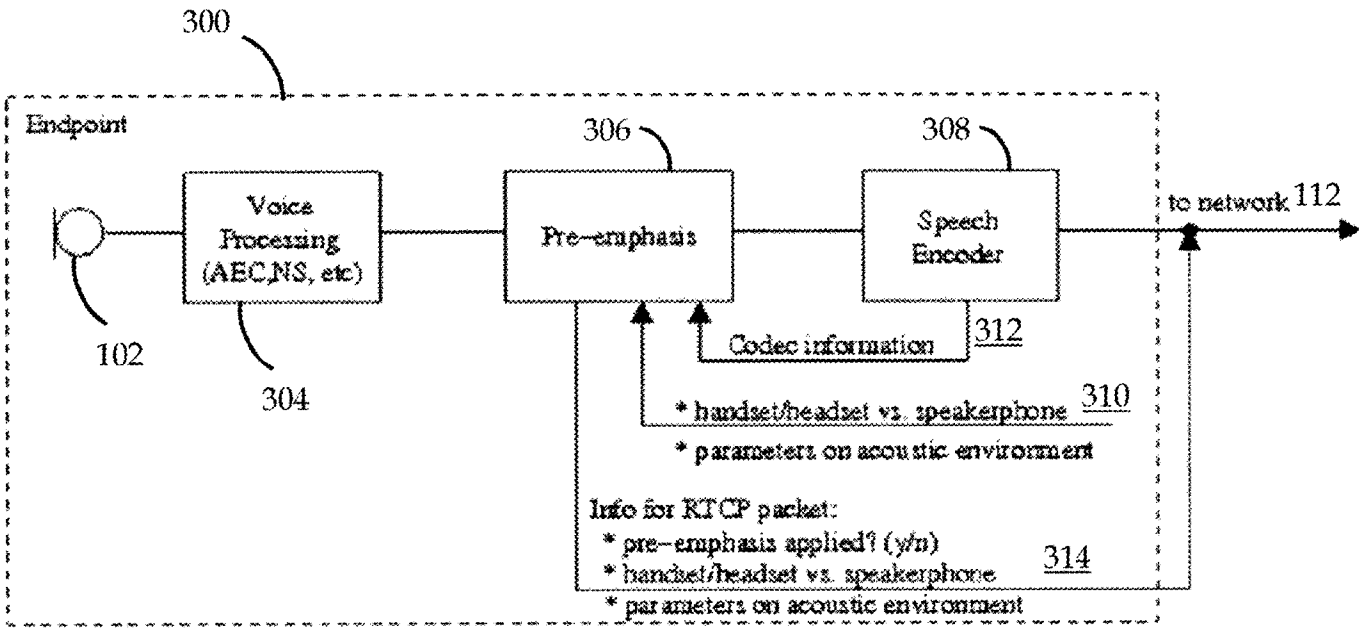
FIG. 3A illustrates at a high level of abstraction a system to provide a pre-emphasis spectral boost, in accordance with an embodiment of the present invention.

FIG. 3A illustrates at a high level of abstraction a system 300 to provide a pre-emphasis spectral boost, in accordance with an embodiment of the invention. System 300 includes telecommunication terminals 102 that is configured to receive a voice signal. The received voice signal may then be transmitted to a voice processing module 304. Voice processing module 304 may digitize the voice signal and format the digitized signal into a media data stream using the Real-time Transport Protocol ("RTP"), also known as RFC 3550 (formerly RFC 1889). RTP is used for transporting real-time data and providing Quality of Service ("QoS") feedback.

The Real-Time Transport Control Protocol ("RTCP") is a protocol that is known and described in RFC 3550. RTCP provides out-of-band statistics and control information for an RTP media stream. It is associated with RTP in the delivery and packaging of a media stream, but does not transport the media stream itself. Typically RTP will be sent on an even-numbered UDP port, with RTCP messages being sent over the next higher odd-numbered port. RTCP may be used to provide feedback on the quality of service ("QoS") in media distribution by periodically sending statistics information to participants in a streaming multimedia session. Systems implementing RTCP gather statistics for a media connection and information such as transmitted octet and packet counts, lost packet counts, jitter, and round-trip delay time. An application program may use this information to control quality of service parameters, for instance by limiting a flow rate or by using a different codec.

Voice processing module 304 may further apply voice processing techniques known in the art such as acoustic echo cancellation ("AEC"), noise suppression ("NS"), and so forth. The processed voice signal may then be transmitted to a pre-emphasis module 306. Pre-emphasis module 306 may provide a configurable amount of high-frequency spectral boost, with the amount of spectral boost controlled by one or more parametric inputs 310 and/or codec information feedback 312 from speech encoder 308. The parametric inputs 310 may include an indication of the telecommunications endpoint 102 being used (e.g., whether the telecommunications endpoint 102 is a handset/headset or a speakerphone that may need additional high-frequency spectral boost), and parameters about the acoustic environment of telecommunications endpoint 102. On a handset and/or a headset endpoint, the amount of pre-emphasis and/or post-emphasis is dependent upon the codec itself. In contrast, on a hands-free endpoint, more high-frequency gain is needed as the acoustic environment becomes more reverberant. The amount of reverberation can be measured by the "T_60" time, i.e., the time it takes for energy of a reverberation to be attenuated by 60 dB.

Pre-emphasis module 306 may modify or generate RTCP packets 314 that describe the acoustic environment of endpoint 102 and/or describe the processing applied to the encoded voice signal. For example, the RTCP packets 314 may be generated or modified to include: an indication of whether or not a pre-emphasis had been applied; an indication of whether endpoint 102 is using a handset/headset or is using a speakerphone; an indication of parameters related to the acoustic environment of endpoint 102; an identification of speech encoder 308; and so forth. Embodiments in accordance with the present invention may provide additional information in the RTCP packets for the benefit of downstream processing. The RTCP packets provide out-of-band statistics and control information for the associated processed voice signal transported by the RTP media data stream.

A spectrally emphasized signal outputted from pre-emphasis module 306 may then be supplied to speech encoder 308. Encoder 308 may be a standard encoder known in the art, such as G.729 or any other low-bandwidth codec, such as G.723.1, iLBC, SILK, etc. The encoded output from speech encoder 308 is an RTP media data stream that is associated with the RTCP packets produced by pre-emphasis module 306, and is then injected into network 112 (e.g., Internet, an intranet, a wide area network ("WAN"), etc.) for delivery to one or more recipients.

Figure 3B:
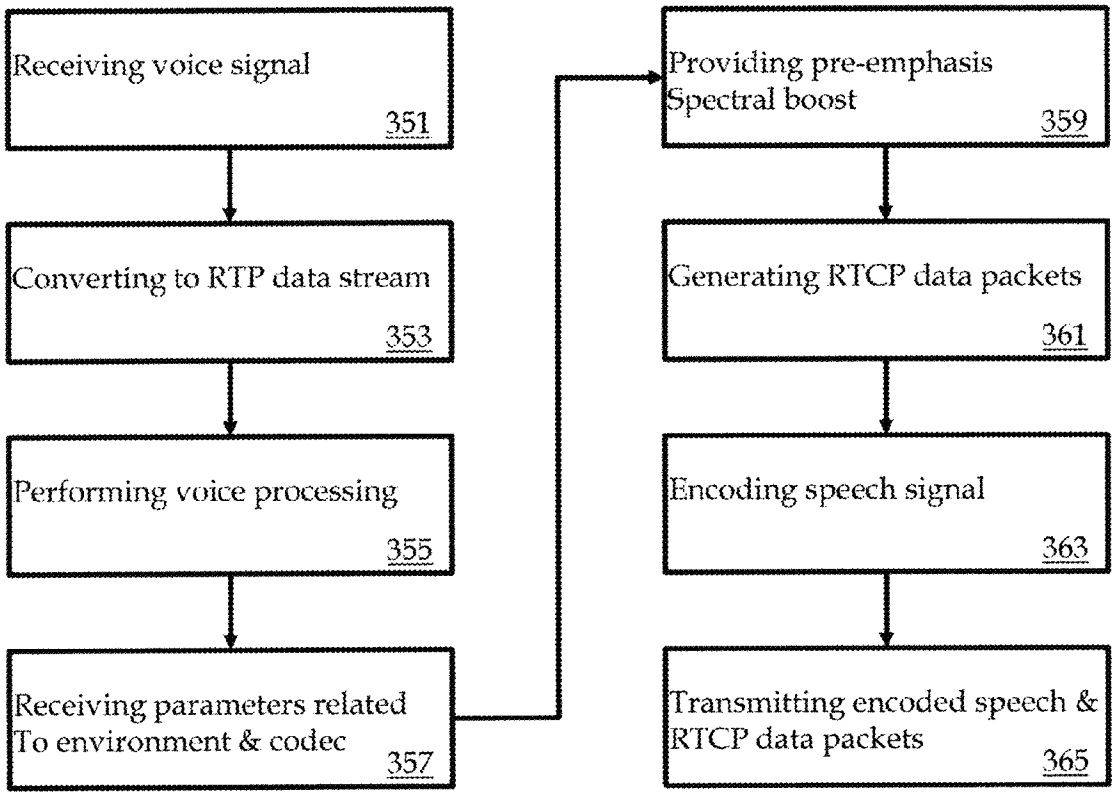
FIG. 3B illustrates at a high level of abstraction a method to provide a pre-emphasis spectral boost, in accordance with an embodiment of the present invention.

FIG. 3B illustrates at a high level of abstraction a method 350 to provide a pre-emphasis spectral boost, in accordance with an embodiment of the invention. Method 350 begins at step 351 with receiving a voice signal. For instance, this would be a voice signal as received from telecommunications terminal 102. Next, at step 353, is the step of converting the voice signal to an RTP media data stream.

Next, at step 355, is the step of performing voice processing on the RTP media data stream. Although performing the voice processing is depicted as operating in a digital realm on the RTP media data stream, it should be understood that voice processing may also be performed in an analog realm prior to conversion to an RTP media data stream, or by a combination of analog and digital processing.

Next, at step 357, is the step of receiving parameters related to the environment. For example, this may include an indication of the telecommunications endpoint 102 being used (e.g., whether the telecommunications endpoint 102 is a handset/headset or a speakerphone that may need additional high-frequency spectral boost), and parameters about the acoustic environment of telecommunications endpoint 102.

Next, at step 359, is the step of providing a pre-emphasis high-frequency spectral boost. The high-frequency spectral boost may be provided by a digital filter as a configurable amount of boost, with the amount of spectral boost controlled by one or more of the parametric inputs and/or codec information feedback received in step 357.

Next, at step 361, is the step of generating RTCP data packets. The RTCP data packets may include: an indication of whether or not a pre-emphasis had been applied; parameters received at step 357 such as an indication of whether endpoint 102 is using a handset/headset or is using a speakerphone or an indication of parameters related to the acoustic environment of endpoint 102; an identification of a speech encoder that will be used; and so forth. Embodiments in accordance with the present invention may provide additional information in the RTCP packets for the benefit of downstream processing. The RTCP packets provide out-of-band statistics and control information for the associated processed voice signal transported by the RTP media data stream.

Next, at step 363, is the step of encoding the speech signal using a codec such as G.729.

Next, at step 365, is the step of transmitting the encoded speech and associated RCTP data packets to a network such as packet-switched wide area network 112.

Figure 4A:
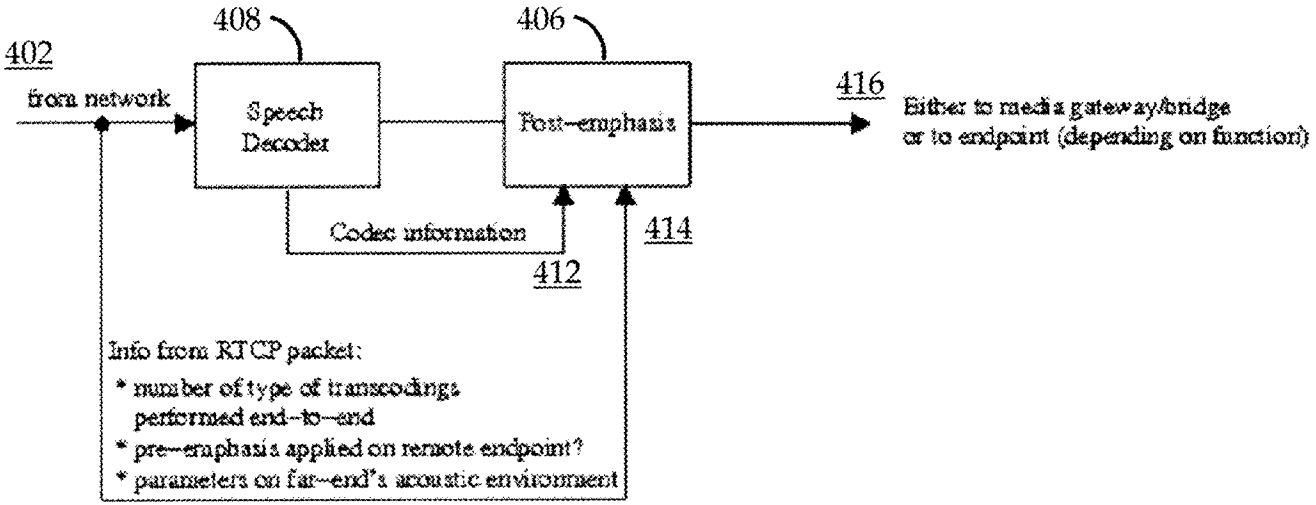
FIG. 4A illustrates at a high level of abstraction a system to provide a post-emphasis spectral boost, in accordance with an embodiment of the present invention.

FIG. 4A illustrates at a high level of abstraction a system 400 to provide a high-frequency post-emphasis spectral boost, in accordance with an embodiment of the invention. System 400 includes an interface 402 that is configured to receive a digitized voice signal from a network (e.g., Internet, an intranet, a wide area network ("WAN"), etc.). The voice signal may be received as an RTP media data stream together with an associated RCTP control flow. The RTP media data stream may then be transmitted to a speech decoder module 408. Decoder 408 may be a standard decoder known in the art, such as G.729. Speech decoder module 408 decodes the encoded voice signal into linear pulse coded modulation ("PCM") (encoded format that can be further processed by post-emphasis module 406. Speech decoder module 408 may also transmit codec information 412 to post-emphasis module 406 for use either by post-emphasis module 406 or for further downstream processing via interface 416.

Post-emphasis module 406 may provide a configurable amount of high-frequency spectral boost, with the amount of spectral boost controlled by information extracted from the associated RCTP control flow 414 and/or codec information 412 from speech decoder 408. The associated RCTP control flow may include information useful to help decode and/or provide post-emphasis to the RTP media data stream. For example, the associated RCTP control flow may include: a sum total of the number of transcodings performed end-to-end on this RTP media data stream; whether or not pre-emphasis had been performed at a remote endpoint such as the originating endpoint of FIG. 3A; and parameters related to the acoustic environment of the far end, such as the far end depicted in FIG. 3A.

The output 416 of post-emphasis module 406 may be routed to a telecommunications network endpoint (e.g., telecommunications terminal 102), or it may be routed to a media gateway/bridge for transmission to another network.

Embodiments in accordance with the present invention may incorporate high-frequency gains into speech decoder throughout a network in order to deliver better performance such as a more intelligible and/or higher quality decoded speech signal. Another set of pre-emphasis and post-emphasis filters may be used at network locations where transcodings take place. RTCP packets may be used to keep track of the configuration. No two speech codecs are generally alike, therefore different correction filters may be used, which have coefficients that can be determined experimentally. An experimental procedure for determining filter coefficients may include running a range of speech signals through a number of tandem encodings in order to reveal the nature of the impairments, and designing corrective actions (i.e., filters) as a result of these observations.

Alternative embodiments in accordance with the present invention may use, at an endpoint of the audio stream connection, an aggregated filter in its decoder, the aggregated filter representing a composite spectral response of the codecs that the audio signal has passed through. The aggregate filter may avoid having to change signal processing performed in other network components.

In an embodiment in accordance with the present invention, the aggregated filter may provide a varying or an adjustable level of boost. For example, in order to determine the appropriate aggregated filter, the endpoint may start with a predetermined level of boost, e.g. 6 dB of high-frequency gain. This level of boost may be made user-adjustable. Simulations and listening tests indicate that a multiple-encoded voice signal incorporating a moderate amount of high-frequency boost is perceived as offering increased intelligibility than a multiple-encoded voice signal without any high-frequency boost.

In another embodiment in accordance with the present invention, proprietary data extensions may be used in the Real-Time Transport Control Protocol ("RTCP") packets to include codec information pertaining to network components that the packet carrying the audio stream (e.g., VoIP traffic) passes through. For example, information about each successive codec that the audio stream passes through (e.g., codec type, codec-specific parameters, etc.) may be appended as part of the RTCP extension by a media gateway or conference bridge to control information in the audio stream. An endpoint of the audio stream connection may then construct a boost that attempts to compensate for filtering in the codecs that the audio stream has passed through.

Figure 4B:
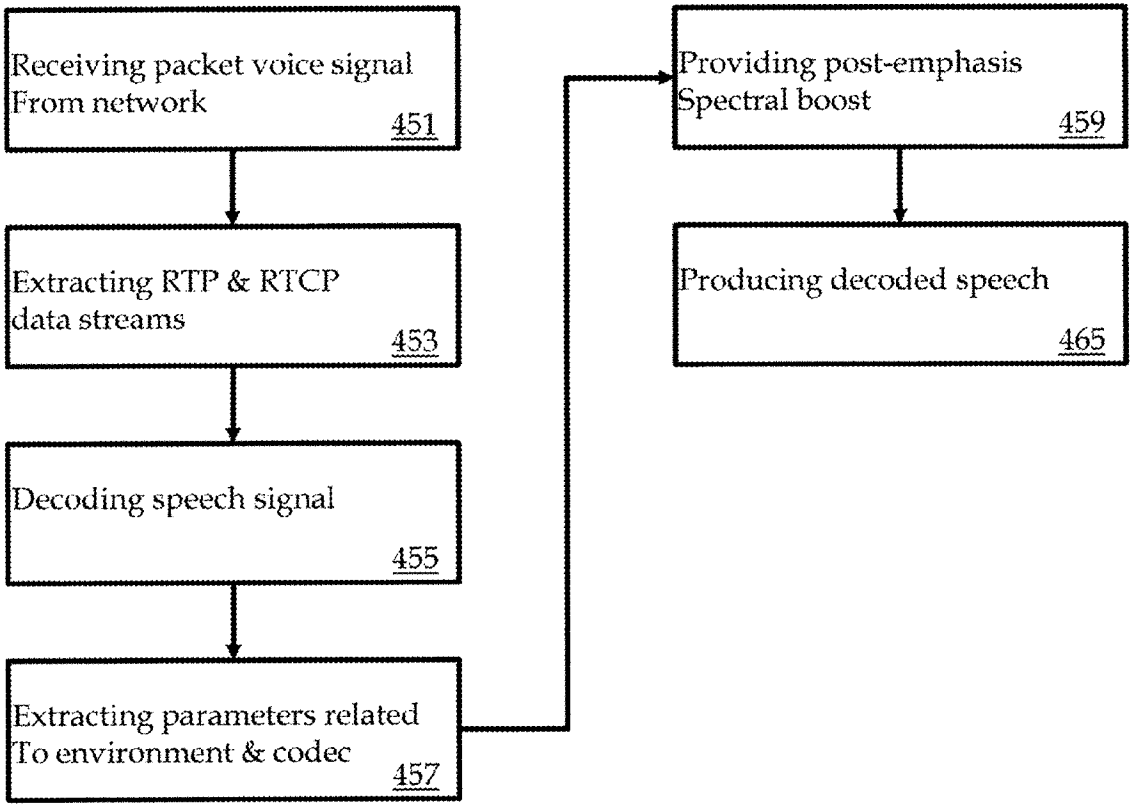
FIG. 4B illustrates at a high level of abstraction a method to provide a post-emphasis spectral boost, in accordance with an embodiment of the present invention.

FIG. 4B illustrates at a high level of abstraction a method 450 to provide a post-emphasis spectral boost, in accordance with an embodiment of the invention. Method 450 begins at step 451 with receiving a packet voice signal from a network such as network 112.

Next, at step 453, is the step of extracting the RTP media data stream and one or more associated RTCP control data packets from the packet voice signal.

Next, at step 455, is the step of decoding the speech signal.

Next, at step 457, is the step of extracting from the RTCP data stream and/or speech decoder 408 the parameters related to the environment and/or the codec.

Next, at step 459, is the step of providing a high-frequency post-emphasis spectral boost. The high-frequency spectral boost may be provided by a digital filter as a configurable amount of boost, with the amount of spectral boost controlled by one or more of the parametric outputs and/or codec information feedback received in step 457.

Next, at step 465, is the step of producing the decoded speech. The decoded speech may be transmitted, for example, to a telecommunications terminal 102 if process 450 performed at an endpoint of a call. Alternatively, if process 450 is performed at a point in the interior of a network, the decoded speech may be transmitted to another media gateway/bridge for further processing.

Figure 5:
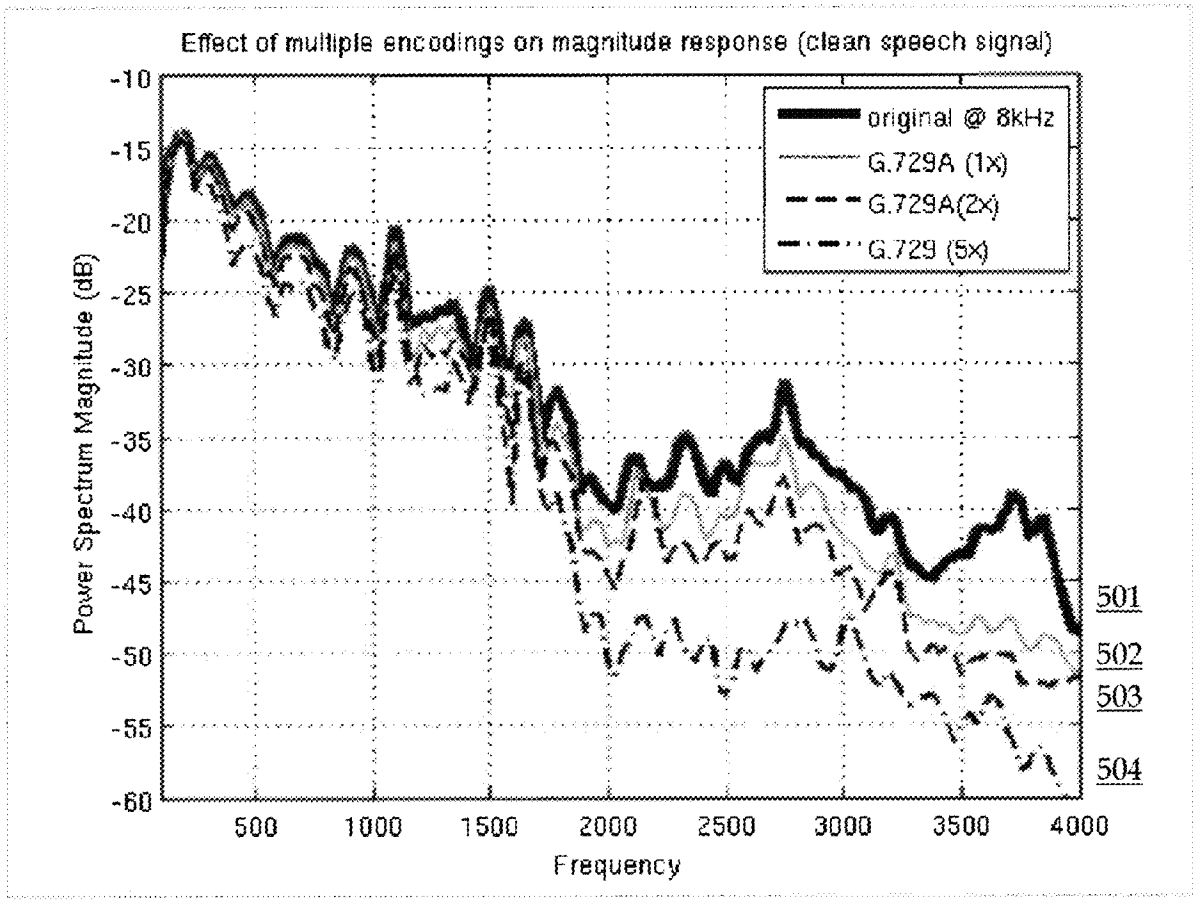
FIG. 5 illustrates effects of multiple encodings on a magnitude response, in accordance with an embodiment of the present invention.

FIG. 5 illustrates effects of multiple encodings on a magnitude response, using a clean input speech signal. The data was determined by running a speech signal through the ITU-T reference implementation of G.729. Test results have been confirmed by running speech signals through a terminal that has been forced to use G.729. Curve 501 is the original spectral shape of a voice signal that has been sampled at a rate of 8 Ksamples/sec, with 8 bits per sample. The signal of curve 501 had been recorded in an acoustically benign environment substantially devoid of noise and reverberation (i.e., by usage of a headset and/or a handset). Curve 502 is a corresponding spectral plot of a voice signal that has been encoded one time by a G.729A encoder. Curve 503 is a corresponding spectral plot of a voice signal that has been encoded two times by a G.729A encoder. Curve 504 is a corresponding spectral plot of a voice signal that has been encoded five times by a G.729A encoder. As is apparent from FIG. 5, there is a progressive attenuation of high-frequency spectral components, particularly above 1500 Hz, which takes place with an increased number of repetitions of G.729A encoding.

Although the results of FIG. 5 pertain to G.729A encoding, the general phenomenon can be observed with most legacy and modern speech codecs, with the exception of G.711 and G.722, to a varying degree.

Figure 6:
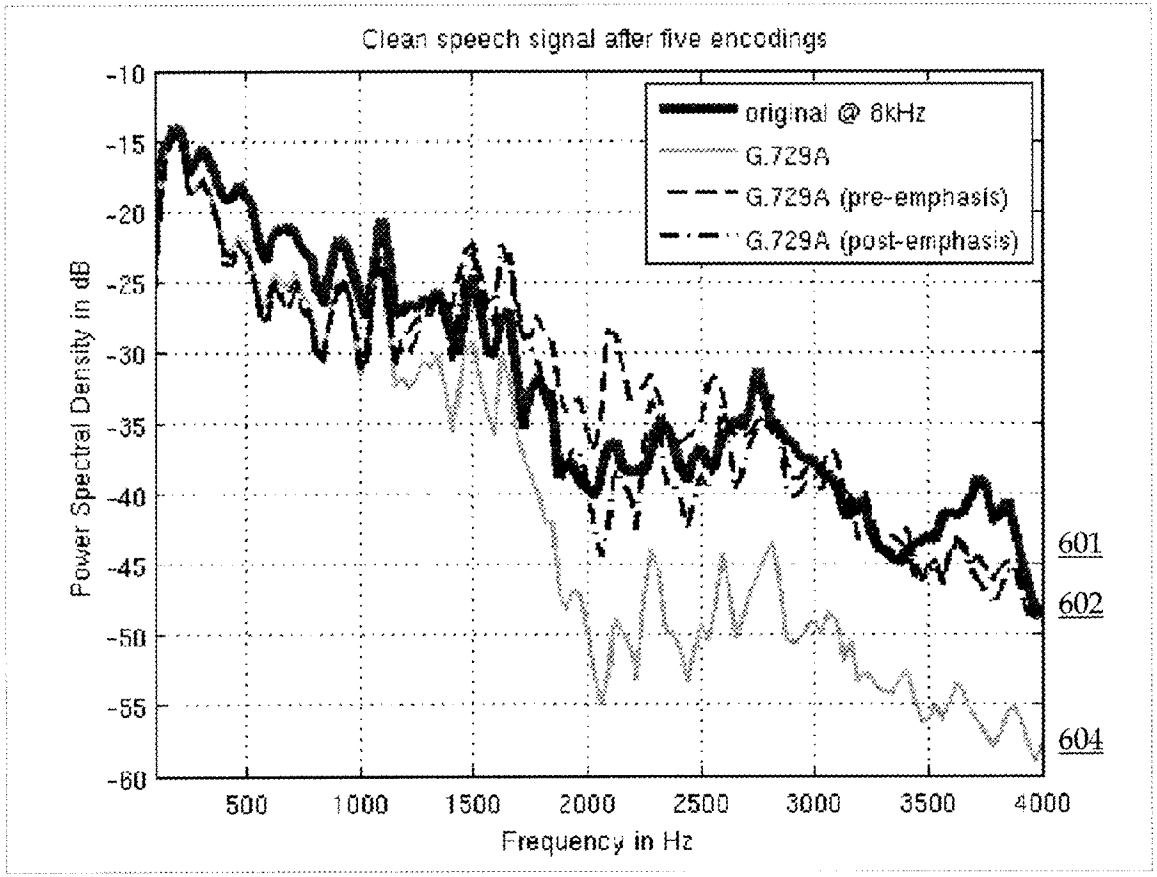
FIG. 6 illustrates effects of pre-emphasis and post-emphasis processing, in accordance with an embodiment of the present invention.

FIG. 6 illustrates effects of pre-emphasis and post-emphasis processing, in accordance with an embodiment of the present invention, of a clean input speech signal that has undergone five G.729A encodings. Curve 601 is the original spectral shape of a voice signal that has been sampled at a rate of 8 Ksamples/sec, with 8 bits per sample. Curve 604 is a corresponding spectral plot of a voice signal that has been encoded five times by a G.729A encoder, without any spectral boost. Reference item 602 refers to two spectral plots which are similar above approximately 2700 Hz. One of the curves represented by reference item 602 was generated by applying pre-emphasis in accordance with an embodiment of the present invention. The other curve represented by reference item 602 was generated by applying post-emphasis in accordance with an embodiment of the present invention. As is apparent from FIG. 6, both of the spectral plots represented by reference item 602 match curve 601 more closely than curve 604, particularly above 1500 Hz.

The spectral boost used to generate the plots 602 was implemented by passing the original digitized voice signal through a second-order IIR digital high-pass filter. Such digital filters are computationally inexpensive, therefore the filters may be deployed in many network components that perform speech decoding. More complex digital filtering may be implemented, for example to take advantage of knowledge available via the RTCP data packets, such as the acoustic environment where an endpoint is located, and therefore apply a more tailored correction filter.

Figure 7:
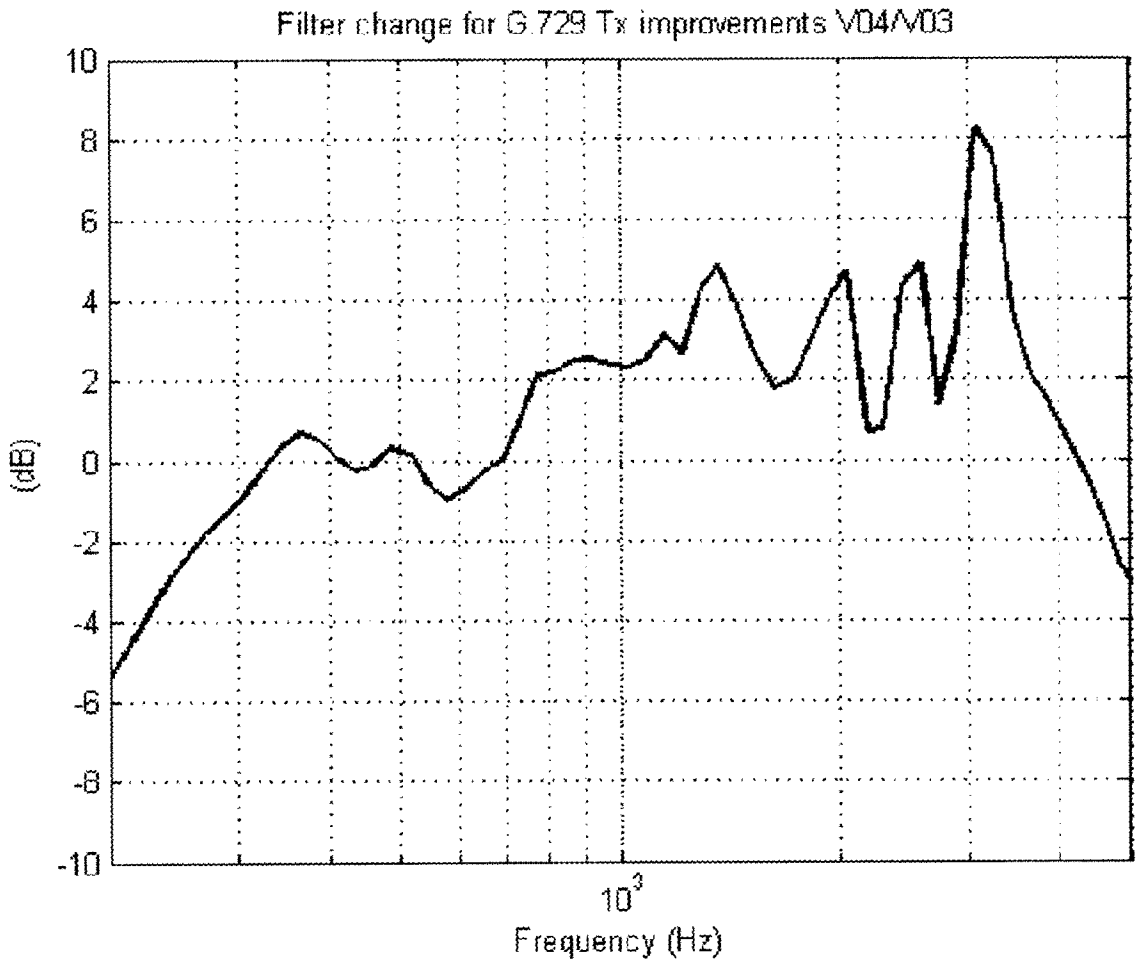
FIG. 7 illustrates spectral effects of a transmit boost, in accordance with an embodiment of the present invention.

FIG. 7 illustrates spectral effects of an experimentally determined transmit boost, in accordance with an embodiment of the present invention. The boost provides a generally increasing amount of gain from 600 Hz-3.0 KHz, and a moderate suppression below 200 Hz. The boost to the transmit side indicated by this spectral profile was able to improve the speech intelligibility using G.729 encoding on Avaya model 96x 1 desk phones.

Embodiments of the present invention include a system having one or more processing units coupled to one or more memories. The one or more memories may be configured to store software that, when executed by the one or more processing unit, implements a high-frequency spectral boost of an encoded voice signal, at least by use of processes described above in connection with the Figures and related text.

The disclosed methods may be readily implemented in software, such as by using object or object-oriented software development environments that provide portable source code that can be used on a variety of computer or workstation platforms. Alternatively, the disclosed system may be implemented partially or fully in hardware, such as by using standard logic circuits or VLSI design. Whether software or hardware may be used to implement the systems in accordance with various embodiments of the present invention may be dependent on various considerations, such as the speed or efficiency requirements of the system, the particular function, and the particular software or hardware systems being utilized.

While the foregoing is directed to embodiments of the present invention, other and further embodiments of the present invention may be devised without departing from the basic scope thereof. It is understood that various embodiments described herein may be utilized in combination with any other embodiment described, without departing from the scope contained herein. Further, the foregoing description is not intended to be exhaustive or to limit the invention to the precise form disclosed. Modifications and variations are possible in light of the above teachings or may be acquired from practice of the invention.

No element, act, or instruction used in the description of the present application should be construed as critical or essential to the invention unless explicitly described as such. Also, as used herein, the article "a" is intended to include one or more items. Where only one item is intended, the term "one" or similar language is used. Further, the terms "any of" followed by a listing of a plurality of items and/or a plurality of categories of items, as used herein, are intended to include "any of," "any combination of," "any multiple of," and/or "any combination of multiples of" the items and/or the categories of items, individually or in conjunction with other items and/or other categories of items.

Moreover, the claims should not be read as limited to the described order or elements unless stated to that effect. In addition, use of the term "means" in any claim is intended to invoke 35 U.S.C. §112, ¶ 6, and any claim without the word "means" is not so intended.

What is claimed is:

1. A method to improve intelligibility of coded speech, comprising:
- receiving an encoded speech signal from a network;
- extracting an encoded media data stream and one or more control data packets from the encoded speech signal;
- decoding the encoded media data stream to produce a decoded speech signal;
- boosting an upper spectral portion of the decoded speech signal to produce a boosted speech signal, wherein an amount and spectral shape of the boost is determined by:
  - a number of type of transcodings performed end-to-end;
  - whether pre-emphasis had been applied at a remote endpoint; and
  - parameters related to an acoustic environment; and
- outputting the boosted speech signal.

2. The method of claim 1, wherein the step of boosting an upper spectral portion comprises high-pass filtering the decoded speech signal.

3. The method of claim 1, wherein the step of boosting an upper spectral portion comprises amplifying an upper spectral portion.

4. The method of claim 1, wherein the one or more control data packets comprises information about an originating telecommunications terminal.

5. The method of claim 1, wherein the step of boosting an upper spectral portion comprises boosting based upon an information about an acoustic environment of the originating telecommunications terminal.

6. The method of claim 1, wherein the step of boosting an upper spectral portion comprises boosting based upon an aggregated response of codecs that the encoded speech signal had passed through.

7. A method to improve intelligibility of coded speech, comprising:
- receiving an uncoded speech signal;
- processing the uncoded speech signal, wherein the processing comprises generating an unencoded data stream from the uncoded speech signal;
- boosting an upper spectral portion of the decoded speech signal to produce a boosted speech signal, wherein an amount and spectral shape of the boost is determined by:
  - whether post-emphasis will be applied at a remote endpoint; and
  - parameters related to an acoustic environment;
- encoding the boosted speech signal to produce an encoded speech signal; and
- outputting the boosted speech signal.

8. The method of claim 7, wherein the step of boosting an upper spectral portion comprises high-pass filtering the decoded speech signal.

9. The method of claim 7, wherein the step of boosting an upper spectral portion comprises amplifying an upper spectral portion.

10. The method of claim 7, wherein the step of boosting an upper spectral portion comprises producing one or more control data packets.

11. The method of claim 10, wherein the one or more control data packets comprises information about an originating telecommunications terminal.

12. The method of claim 7, wherein the step of boosting an upper spectral portion comprises boosting based upon an information about an acoustic environment of the originating telecommunications terminal.

13. A system to improve intelligibility of coded speech, comprising:
- a receiver configured to receive an encoded speech signal from a network;
- an extraction module configured to extract an encoded media data stream and one or more control data packets from the encoded speech signal;
- a decoder configured to decode the encoded media data stream to produce a decoded speech signal;
- a frequency-selective booster configured to boost an upper spectral portion of the decoded speech signal to produce a boosted speech signal, wherein an amount and spectral shape of the boost is determined by:
  - a number of type of transcodings performed end-to-end;
  - whether pre-emphasis had been applied on a remote endpoint; and
  - parameters related to a far-end acoustic environment; and
- a transmitter configured to transmit the boosted speech signal.

14. The system of claim 13, wherein the frequency-selective booster comprises a high-pass filter.

15. The system of claim 13, wherein the frequency-selective booster comprises an amplifier configured to amplify an upper spectral portion.

16. The system of claim 13, wherein the one or more control data packets comprises information about an originating telecommunications terminal.

17. The system of claim 13, wherein the frequency-selective booster is configured to boost an upper spectral portion based upon an information about an acoustic environment of the originating telecommunications terminal.

* * * * *

UNITED STATES PATENT AND TRADEMARK OFFICE

CERTIFICATE OF CORRECTION

PATENT NO. : 8,645,142 B2
APPLICATION NO. : 13/430936
DATED : February 4, 2014
INVENTOR(S) : Teutsch et al.

It is certified that error appears in the above-identified patent and that said Letters Patent is hereby corrected as shown below:

On the Title page, Item (54) and in the Specification, Column 1, Lines 1-4, Title "SYSTEM AND METHOD FOR METHOD FOR IMPROVING SPEECH INTELLIGIBILITY OF VOICE CALLS USING COMMON SPEECH CODECS" should read -- SYSTEM AND METHOD FOR IMPROVING SPEECH INTELLIGIBILITY OF VOICE CALLS USING COMMON SPEECH CODECS --.

Signed and Sealed this
Third Day of June, 2014

Michelle K. Lee

Michelle K. Lee
*Deputy Director of the United States Patent and Trademark Office*